United States Patent [19]

D'Antonio et al.

[11] Patent Number: 4,821,839

[45] Date of Patent: Apr. 18, 1989

[54] SOUND ABSORBING DIFFUSOR

[75] Inventors: Peter D'Antonio, Largo, Md.; John H. Konnert, Reston, Va.

[73] Assignee: RPG Diffusor Systems, Inc., Largo, Md.

[21] Appl. No.: 37,244

[22] Filed: Apr. 10, 1987

[51] Int. Cl.[4] ..... E04B 1/82

[52] U.S. Cl. ..... 181/198; 181/286; 181/288; 181/291; 181/293

[58] Field of Search ..... 181/30, 175, 286, 288, 181/293, 295

[56] References Cited

U.S. PATENT DOCUMENTS

| | | | |
|---|---|---|---|
| 1,875,074 | 8/1932 | Mason | 181/293 |
| 2,567,070 | 9/1951 | Hjastsater | 181/284 X |
| 4,244,439 | 1/1981 | Wested | 181/288 X |
| 4,330,046 | 5/1982 | Lerner et al. | 181/295 X |

*Primary Examiner*—B. R. Fuller

*Attorney, Agent, or Firm*—H. Jay Spiegel

[57] ABSTRACT

Disclosed herein is an improved sound absorbing diffusor device wherein the surface designed to face the sound source includes a plurality of sound absorbing wells of equal widths but different depths separated by thin sound absorbing dividers. The depths of the individual wells are based upon the quadratic-residue number theory sequence which is used in acoustic design. The wells are covered with an open weave fabric adhered thereover which fabric is specifically chosen for its ability to allow sound to pass therethorugh to the wells and dividers. Tests performed on the inventive sound absorbing diffusor have revealed significant reduction in sound levels of reflected sounds over that which would accrue from a flat absorptive panel.

7 Claims, 6 Drawing Sheets

SOUND ABSORBING DIFFUSOR

BACKGROUND OF THE INVENTION

In the prior art, acoustic well diffusors are known, however, those of which applicants are aware are designed with an intent to shape and contour the reflected sound waves rather than to absorb them. In this regard, reference is made to applicants' two pending design patent applications, Ser. No. 774,882 filed Sept. 11, 1985 and Ser. No. 008,430 filed Jan. 29, 1987, on acoustical diffusors. Applicants are aware of no phase grating systems whose main purpose is that of sound absorbtion.

SUMMARY OF THE INVENTION

The present invention overcomes the deficiencies in the prior art and provides a new improved sound absorbing diffusor device which absorbs sound from any angle of incidence over a wide range of frequencies, which is easy to manufacture and install and which provides significant sound absorbing advantages over untreated areas. The present invention includes the following interrelated aspects and elements:

(a) In the preferred embodiment of the present invention, the improved sound absorbing diffusor takes the form of a box-like housing having a back, sides, top, bottom and front.

(b) In the preferred embodiment, the front of the diffusor housing includes a plurality of wells which are narrow and elongated, and parallel to one another. The wells are of substantially equal widths as compared to one another and creates a phase grating. While the wells have substantially equal widths, their depths differ from one another and the depth of each particular well is calculated based upon the quadratic-residue number theory sequence.

(c) The quadratic-residue number theory sequence is based upon a formula, $n^2$ (modulo N) where N is a prime number, developed by Karl Frederick Gauss. In the example used in the present invention, which is only exemplary, the modulus number chosen is 7. The sequence values for the wells numbered zero to n are determined by the remainder after dividing the well number squared by the modulus. The well depths are equal to the sequence value multiplied times a chosen constant x (See Table A). Thus, in determining the depths of the individual wells, the square of the number of each well is compared to multiples of 7. Thus, with reference to Table A below, it should be clear, for example, that well number 3 has a depth of 2× where x is the constant chosen as desired to determine the actual depths of the wells. In the example of the third well, $3^2$ equals 9 which when divided by the modulus number 7 equals 1 with a remainder of 2, so the depth of the third well will be 2×. In a further example, concerning the fifth well, $5^2$ equals 25 which when divided by 7 (the modulus number) equals 3 with a remainder of 4, thus the fifth well will have a depth of 4×. It should be stressed that the number in Table A under the column headed $n^2$ (mod 7) is the residue or remainder after dividing $n^2$ by the modulus number 7.

TABLE A

| n | $n^2$ | $n^2$ (mod 7) | Depth | Well Depth Where x = .75" in inches |
|---|---|---|---|---|
| 0 | 0 | 0 | 0 | 0 |
| 1 | 1 | 1 | x | 0.75 |
| 2 | 4 | 4 | 4x | 3.00 |
| 3 | 9 | 2 | 2x | 1.50 |
| 4 | 16 | 2 | 2x | 1.50 |
| 5 | 25 | 4 | 4x | 3.00 |
| 6 | 36 | 1 | x | 0.75 |

(d) In the preferred embodiment of the present invention, the sound absorbing diffusor housing is made of a material such as fiberglass with the dividers being made of a material such as pressed mineral fiber sold under the trademark MICORE TM. The wells and dividers are covered by an open weave panel fabric for esthetic reasons. The fabric is installed over the entirety of the housing including top, bottom, sides, front and back and also functions to allow the sound to pass through to the fiberglass where the sound is absorbed.

(e) As will be described in greater detail hereinafter, applicants have tested the sound absorbing properties of the present invention as compared to a flat surface and a sound absorbing flat surface and have determined that the present invention is far superior than a flat surface or a sound absorbing flat surface in absorbing sound waves.

Accordingly, it is the main objective of the present invention to provide an improved sound absorbing diffusor which attenuates a wide range of sound frequencies arriving from any direction by both absorption and diffusion.

It is a further object of the present invention to provide an improved sound absorbing diffusor which includes parallel wells of differing depths based upon the quadratic-residue number theory sequence and which wells as well as the other structure of the diffusor are covered with a sound absorbing material.

It is a further object of the present invention to provide a device which offers attenuation of sound arriving from glancing angles of incidence. While sound arriving at such angles is normally difficult to absorb, the phase grating structure enhances the attenuation by diffusion.

These and other aspects, objects and features of the present invention will be better understood from the following detailed description of the preferred embodiments when read in conjunction with the appended drawing figures.

SPECIFIC DESCRIPTION OF THE PREFERRED EMBODIMENTS

Figure 1:
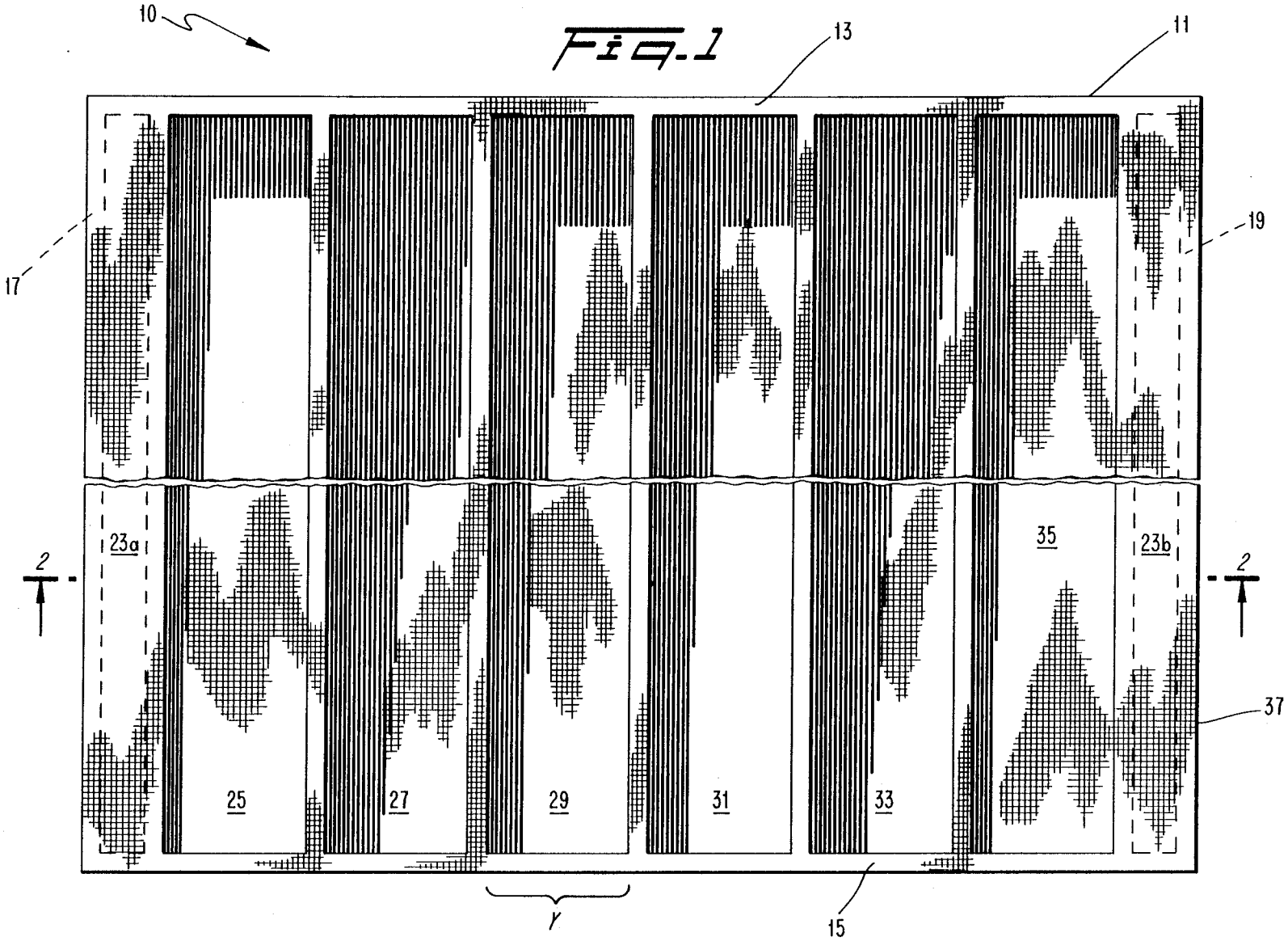
FIG. 1 shows a front view of the present invention.

With reference first to FIG. 1, it is seen that the inventive sound absorbing diffusor 10 includes a housing 11 with a top 13, bottom 15 and sides 17, 19.

Figure 2:
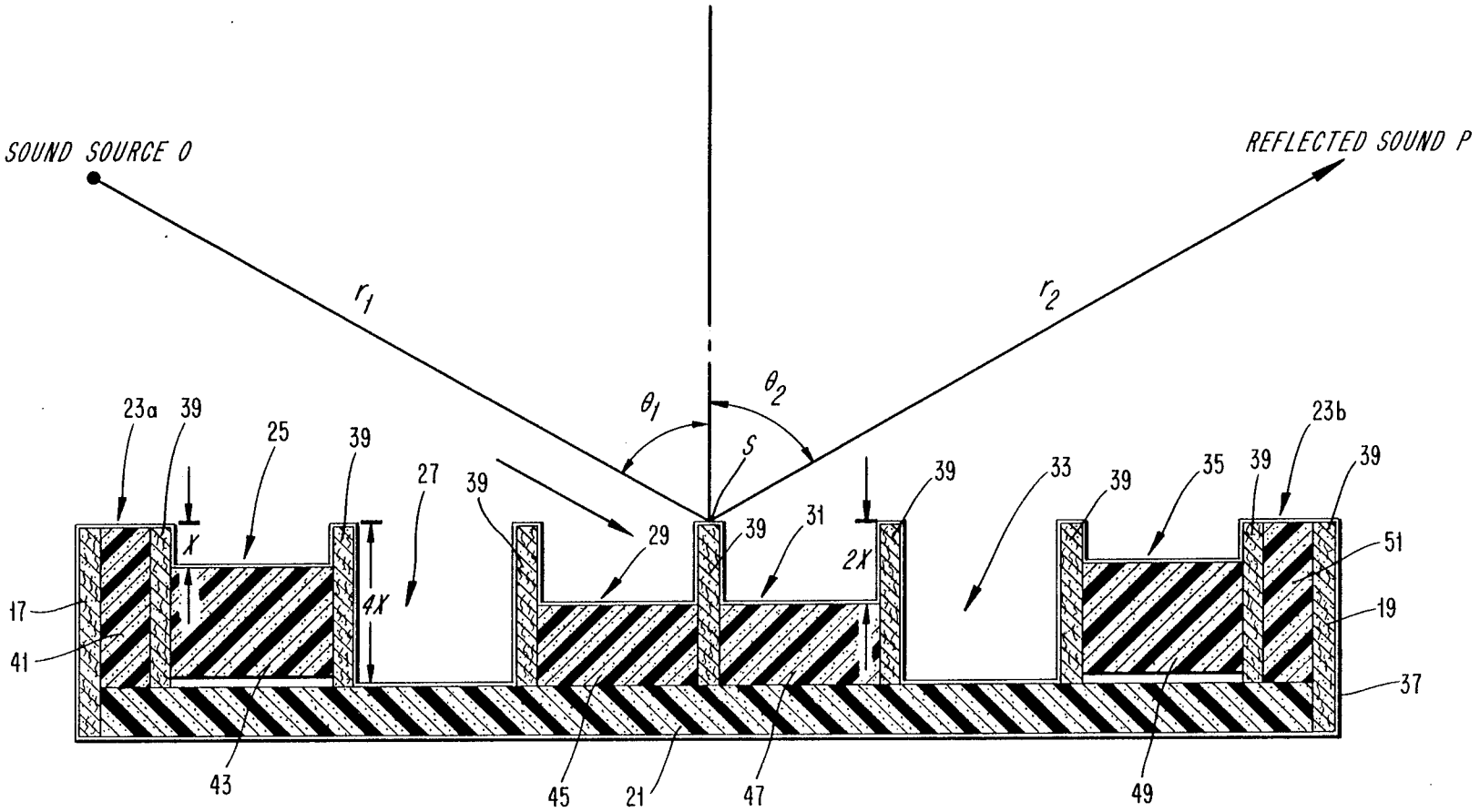
FIG. 2 shows a cross-sectional view along the line 2—2 of FIG. 1.

With reference to FIG. 2, it is seen that the housing 11 also includes a back 21. With reference to FIGS. 1 and 2 it is seen that the housing 11 includes a plurality of wells of differing depths. In FIGS. 1 and 2, the wells are numbered, from left to right, *23a*, 25, 27, 29, 31, 33, 35 and *23b* corresponding, respectively, to n=0, n=1, n=2, n=3, n=4, n=5, n=6 and n=0, in Table A. It should be understood that the wells 25, 27, 29, 31, 33 and 35 are of substantially equal width y with the wells *23a* and *23b* having a width approximately ½y. This has been done so that when two diffusors 10 are placed side by side, a well made up of the well *23b* of the first diffusor and the well *23a* of the second diffusor which are adjacent to one another and having a combined width of y will thereby be created. With reference to FIG. 2, the relationship between the depths of the respective wells is shown proportionate to one another with the relative dimensions being multiplied by the factor "x" as seen in Table A.

With reference to FIGS. 1 and 2, it is seen that the entirety of the diffusor 10 is covered by a panel fabric consisting of Guilford open weave panel fabric, model number FR701. This type of fabric is intended to be exemplary of the fabrics which may be used in accordance with the teachings of the present invention. The fabric, designated by the reference numeral 37, is chosen so the open weave allows sound waves to penetrate the material to be absorbed by the underlying structure of the diffusor. The fabric 37 is attached to the diffusor 10 by any desired means such as, for example, an adhesive.

With reference to FIGS. 1 and 2, the sides 17, 19 define the lateral width of the diffusor 10 and dividers 39 physically divide the wells 23–35 from one another. Furthermore, inserts 41, 43, 45, 47, 49 and 51 made of fiberglass or other porous sound absorbing material are provided between the various dividers and sides to define the depth of the wells. In the example shown in FIGS. 1 and 2, the wells 27 and 33 have no inserts therein since they extend to a depth all the way to the back 21. The other wells have inserts of varying depths as particularly seen in FIG. 2 to define the respective depths thereof.

In the preferred embodiment of the present invention, the back portion 21 and inserts 41, 43, 45, 47, 49 and 51 are made of fiberglass. In the particular example which was tested in accordance with the teachings of the present invention, the fiberglass used consisted of Owens-Corning fiberglass number 705 having a density of 3–5 pounds per cubic foot. The dividers 39 as well as the sides 17, 19, in the preferred embodiment of the present invention are made of pressed mineral fiber manufactured under the trademark MICORE TM. This material is chosen for its combination of rigidity and sound absorbing capability. As stated hereinabove, the fabric 37, in the preferred embodiment of the present invention consists of Guilford open weave panel fabric, model number FR701. Of course, these materials are merely exemplary of the materials which may be used in making the present invention and certainly equivalents in structure and function are known.

The device is constructed of sound absorbing material. The intensity of the sound that is not absorbed is further reduced by diffusion that is the consequence of the quadratic residue sequence of depths. This reduction in sound intensity through both absorption and diffusion may be explained with the formula to follow.

$$U_{(p)} = \frac{1}{4\pi} \quad \frac{\exp\left(\frac{-2\pi i}{\lambda}[r_1(s) + r_2(s)]\right)}{r_1(s)r_2(s)} \times A_{(s)} \times$$

$$\left\{\left(\frac{1}{r_1(s)} + \frac{2\pi i}{\lambda}\right)\cos\theta_1(s) + \left(\frac{1}{r_2(s)} + \frac{2\pi i}{\lambda}\right)\cos\theta_2(s)\right\}ds$$

With further reference to FIG. 2, certain variables are shown in the figure which are used in the above formula. In particular, FIG. 2 shows a sound source 0 wherein sound travels a distance $r_1$ at an angle $\theta_1$ with respect to a line normal to the surface of the diffusor 10 and is reflected at an angle $\theta_2$ to the normal line a distance $r_2$ to a listening point p off the surface s of the diffusor 10. With these terms in mind, the equation set forth above is used to calculate the wave equation $U_{(p)}$ for reflections off a given surface.

In the above formula, $\lambda$ is the wavelength of sound and $A_{(s)}$ is the reflectivity factor for the particular surface which is being employed for reflecting sound waves. To illustrate the absorbing and diffusive properties illustrated in figures 4, 5 and 6, $A_{(2)}$ was set at a value of 1 for a flat, rigid reflecting surface and at 0.5 in the case of either a flat, absorbing surface or an absorbing diffusor such as that which is disclosed in this patent application.

The above formula is known to those skilled in the art as the Kirchhoff integral and when calculated results in obtaining of the wave equation with regard to the terms illustrated in FIG. 2. In calculating the Kirchhoff integral in the case of the diffusor 10, the path lengths $r_1(s)$ and $r_2(s)$ are increased by the depth of the wells at the surface s.

Figure 3:
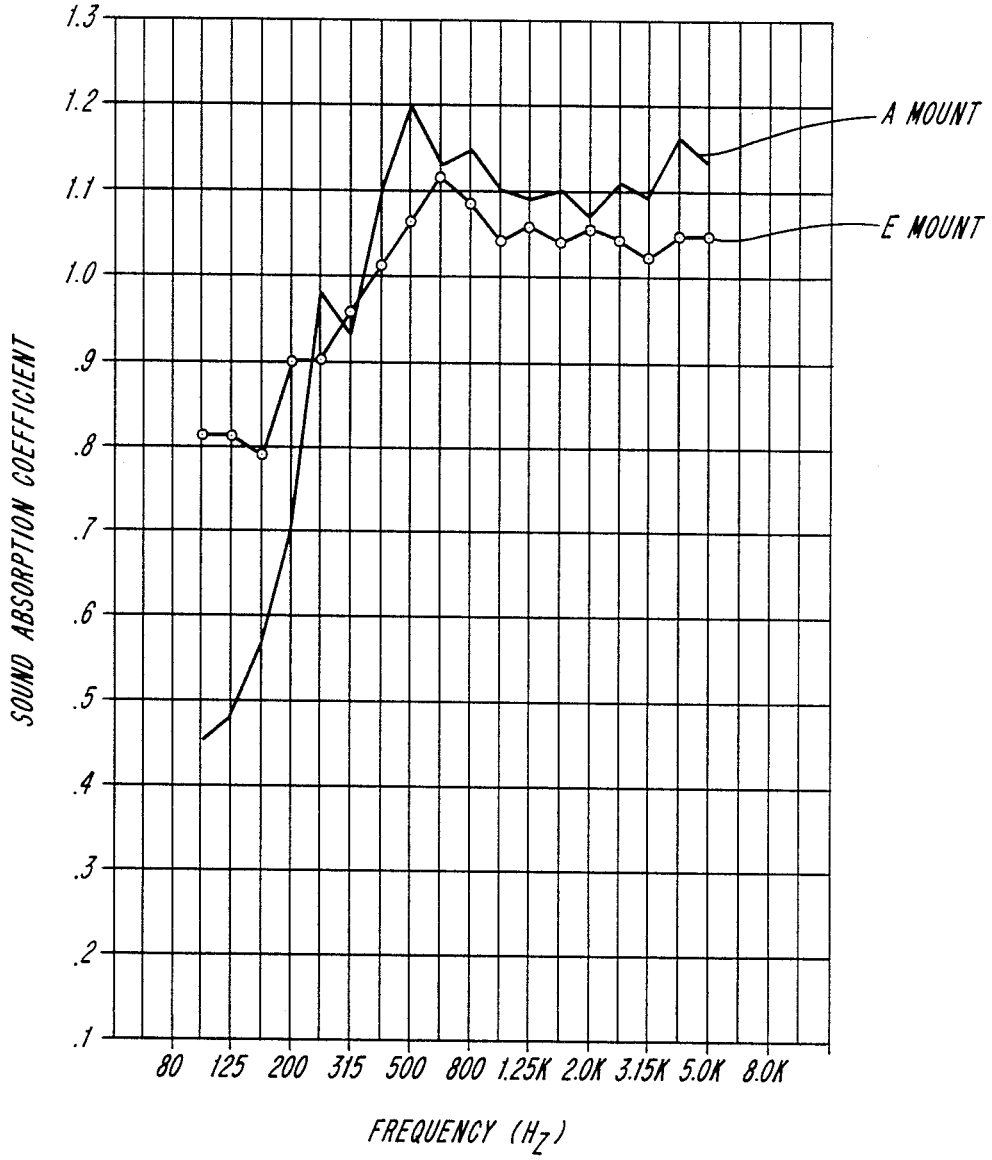
FIG. 3 shows a graph of frequency versus sound absorption coefficient for two tests which were performed on the present invention.

In testing the present invention, two tests were performed with a first test being designated mounting A wherein the diffusor 10 was placed directly on a floor surface and mounting E wherein the diffusor 10 was mounted on the floor surface but with a particular air spacing to the back 21 of the device. In the case of the mounting E test, the spacing was set at 405 millimeters. In each test, the test method was performed by the Riverbank Acoustical Laboratories of IIT Research Institute in Geneva, Ill. and the test method conformed explicitly with the requirements of the American Society for Testing and Materials Standard Test Method for Sound Absorption and Sound Absorption Coefficients by the Reverberation Room Method. Table B shows the test results for mounting A and Table C shows the test results for mounting E. These test results are graphically displayed in FIG. 3.

Next, the theoretical intensity of reflected sound was compared in three different situations, firstly, reflected sound off a rigid flat surface, secondly, reflected sound off an absorbing flat surface and thirdly, reflecting sound off the diffusor 10. The comparison was made through computer generation techniques by programming the computer with the formula for $U_{(p)}$ set for the hereinabove and with the respective assumptions for $A_{(s)}$ corresponding with typical values of $A_{(s)}$ for the three situations tested. These respective situations are displayed respectively in FIGS. 4, 5 and 6 with the source 0 of the incident sound as well as the listening point p being shown.

Figure 4:
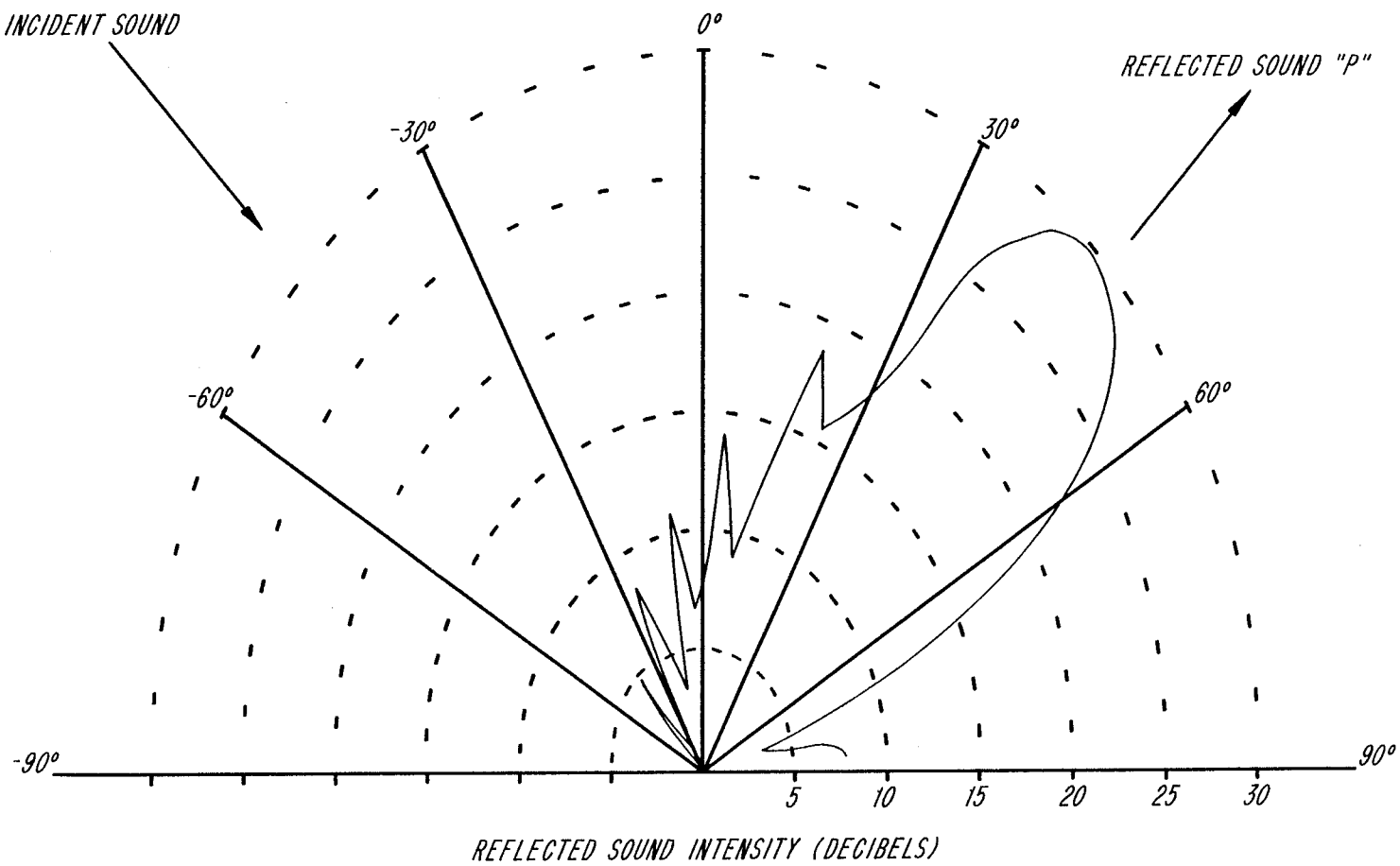
FIG. 4 shows a diagram of reflected sound intensity wherein the reflecting surface consists of a rigid flat surface.
Figure 5:
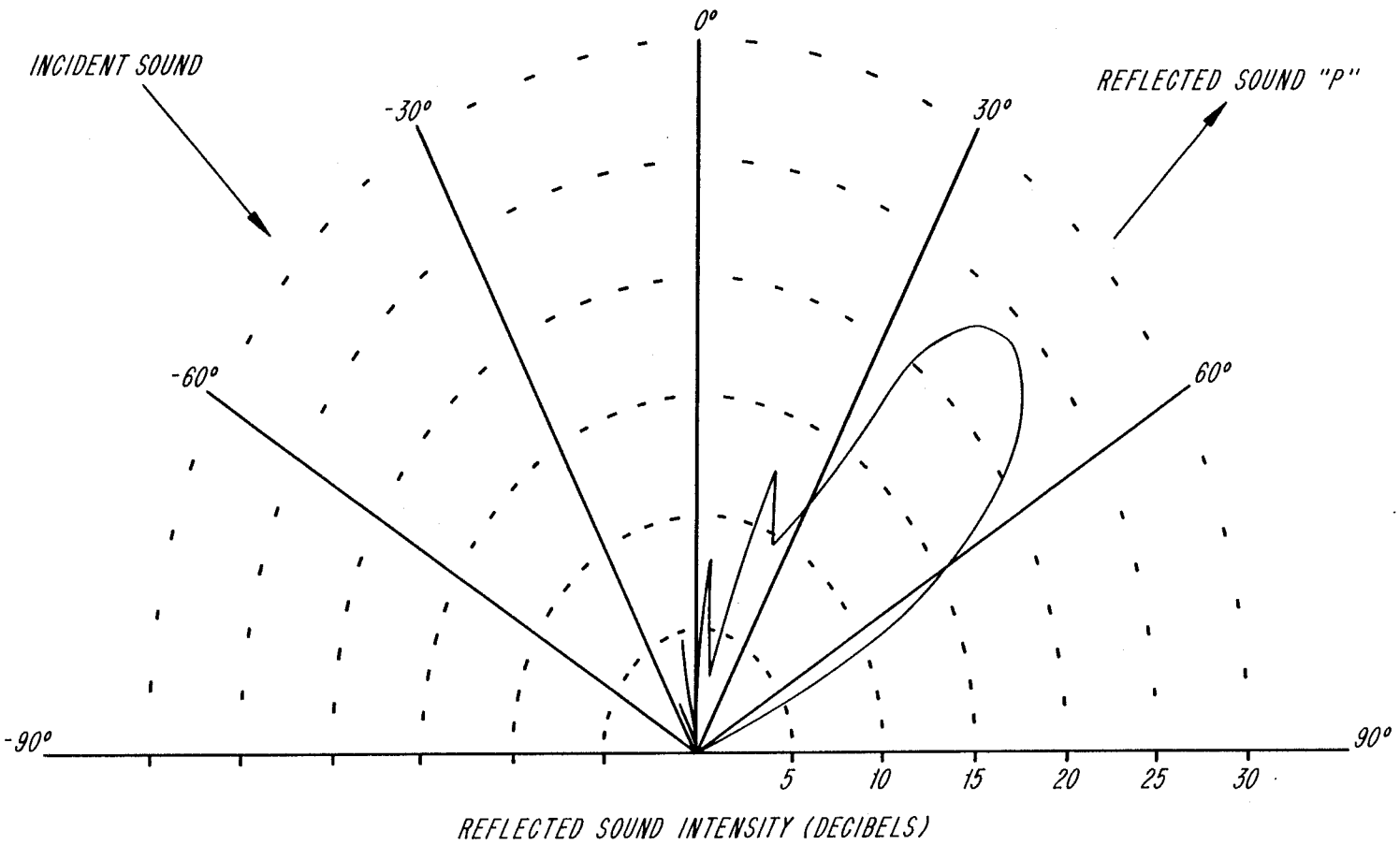
FIG. 5 shows a diagram of reflected sound intensity wherein the reflecting surface consists of an absorbing flat surface.

Referring to FIG. 4, wherein a rigid, flat surface was employed, it is seen that the reflected sound is highly directional falling mainly within the quadrant of 30 degrees to 60 degrees and having a peak sound intensity of approximately 30 decibels. In comparison to this, FIG. 5 shows the situation of a flat surface having absorbing characteristics. In this situation, the reflected sound is still highly directional also mainly falling within the quadrant between 30 degrees and 60 degrees and having a peak sound intensity of approximately 24 decibels.

Figure 6:
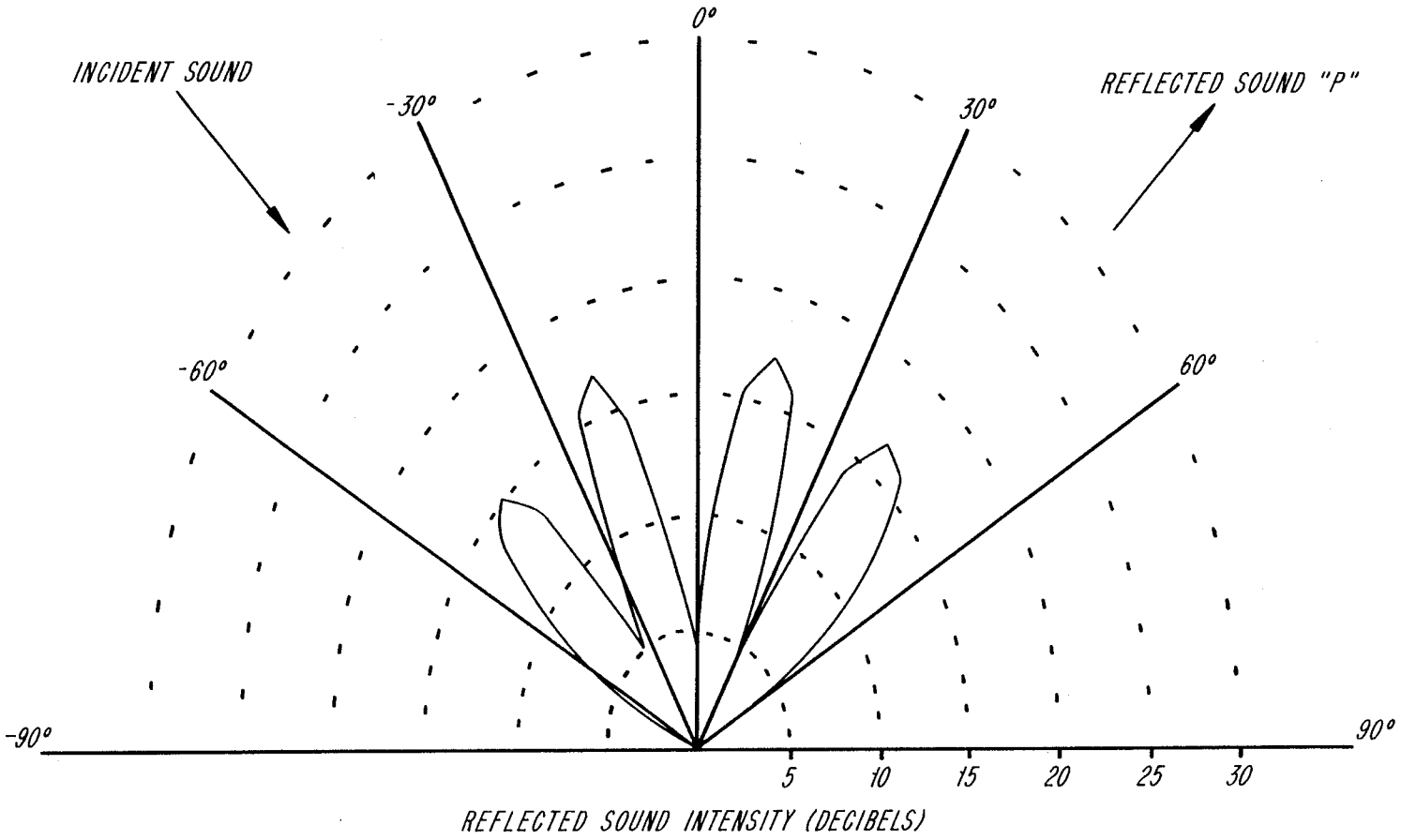
FIG. 6 shows a diagram of reflected sound intensity wherein the reflecting surface consists of the present invention.

Finally, FIG. 6 shows what occurs when the reflecting surface consists of the inventive diffusor 10. As should be clearly seen, the reflected sound is substantially equally dispersed between the quadrants of minus 60 degrees - minus 30 degrees, minus 30 degrees - 0 degrees, 0 degrees - plus 30 degrees and plus 30 degrees - plus 60 degrees. In the test, the peak sound intensity for the latter mentioned three quadrants is approximately equal and at a level of approximately 17 decibels. In the direction of the listener p, the sound intensity of 17 decibels is not only about 13 decibels less than the sound received from the rigid flat surface but also constitutes a reduction of about 7 decibels from the flat absorbing surface. Thus, it is clear that the present invention has significant advantages over other known surfaces which might be used in acoustic situations.

Of course, the present invention is not limited to being made with seven wells and it could be made in a sequence having a number of wells corresponding to any prime number in accordance with the quadratic residue number theory sequence. However, experiments by applicants have led to the conclusion that the sequence with seven wells offers the most favorable functionality for any given well depth.

The absorptive properties of the inventive diffusor 10 extend over a broad range of frequencies as is demonstrated by Tables B and C and FIG. 2.

TABLE B

| ⅓ Octave Center Center Frequency (Hz) | Absorption Coefficient | Total Absorption In Sabins | % Of Uncertainty With 95% Confidence Limit |
|---|---|---|---|
| 100 | 0.45 | 32.14 | 0.78 |
| ** 125 | 0.48 | 34.91 | 0.70 |
| 160 | 0.57 | 41.10 | 0.87 |
| 200 | 0.69 | 49.37 | 0.70 |
| ** 250 | 0.98 | 70.49 | 0.57 |
| 315 | 0.93 | 67.31 | 0.72 |
| 400 | 1.09 | 78.59 | 0.64 |
| ** 500 | 1.20 | 86.22 | 0.65 |
| 630 | 1.13 | 81.18 | 0.59 |
| 800 | 1.15 | 82.58 | 0.66 |
| ** 1000 | 1.10 | 79.51 | 0.69 |
| 1250 | 1.09 | 78.36 | 0.60 |
| 1600 | 1.10 | 79.23 | 0.66 |
| ** 2000 | 1.07 | 77.14 | 0.61 |
| 2500 | 1.11 | 80.01 | 0.71 |
| 3150 | 1.09 | 78.48 | 0.55 |
| ** 4000 | 1.16 | 83.51 | 0.48 |
| 5000 | 1.13 | 81.36 | 0.54 |

NRC = 1.1

TABLE C

| ⅓ Octave Center Center Frequency (Hz) | Absorption Coefficient | Total Absorption In Sabins | % Of Uncertainty With 95% Confidence Limit |
|---|---|---|---|
| 100 | 0.82 | 59.09 | 0.66 |
| ** 125 | 0.82 | 58.78 | 0.63 |
| 160 | 0.78 | 55.91 | 0.67 |
| 200 | 0.90 | 64.70 | 0.65 |
| ** 250 | 0.90 | 65.00 | 0.60 |
| 315 | 0.96 | 69.39 | 0.72 |
| 400 | 1.02 | 73.69 | 0.65 |
| ** 500 | 1.07 | 76.96 | 0.68 |
| 630 | 1.12 | 80.31 | 0.63 |
| 800 | 1.09 | 78.20 | 0.60 |
| ** 1000 | 1.04 | 75.16 | 0.64 |
| 1250 | 1.06 | 76.14 | 0.56 |
| 1600 | 1.04 | 74.69 | 0.58 |
| ** 2000 | 1.05 | 75.33 | 0.68 |
| 2500 | 1.04 | 75.10 | 0.67 |
| 3150 | 1.02 | 73.77 | 0.58 |
| ** 4000 | 1.04 | 74.64 | 0.64 |
| 5000 | 1.04 | 74.62 | 0.61 |

NRC = 1.0

Sound attenuation down to about 500 cycles per second is accomplished by the absorptive properties of the porous fiberglass and the diffusive properties of the phase grating formed by the wells. Below this frequency, the well dividers, the various fiberglass well bottoms and the unit as a whole become diaphragmatic and extend the absorptive properties to lower frequencies. The irregular surface variation of the absorptive phase grating surface caused by the combination of the wells and the absorptive material 37 allows the inventive diffusor 10 to provide broad band width absorption even for sound striking the surface at glancing incidents due to the effective trapping of the sound in the various wells and within the material 37.

Accordingly, an invention has been disclosed in terms of a preferred embodiment thereof which fulfills each and every one of the objects of the invention and provides an improved sound absorbing diffusor device which has significant advantages over the prior art.

Of course, various changes, modifications and alterations in the teachings of the present invention may be contemplated by those skilled in the art without departing from the intended spirit and scope of the present invention. Accordingly, it is intended that the present invention only be limited by the terms of the appended claims.

We claim:

1. An improved sound absorbing diffusor comprising:

(a) a housing; and (b) an irregular sound absorbing surface on said housing;

(c) said surface comprising a plurality of wells of differing depths;

(d) said wells being of particular depths with respect to one another as determined by use of a quadratic residue number theory sequence wherein each consecutive well is given a number from 0 to n where n equals one less than a total number of wells, and wherein a depth of any particular well is determined by squaring said number for said particular well and dividing said squared number by a chosen modulus number resulting in a remainder, the remainder after said dividing being multiplied by a chosen constant to arrive at said depth of said particular well.

2. The invention of claim 1, wherein said wells are parallel.

3. The invention of claim 1, wherein said wells are separated from one another by respective dividers.

4. The invention of claim 3, wherein said dividers are made of pressed mineral fiber.

5. The invention of claim 1, wherein said surface is covered by an open weave fabric which allows sound waves to pass therethrough.

6. The invention of claim 1, wherein said wells have depths formed by sound absorbing inserts mounted in said housing.

7. The invention of claim 6, wherein said inserts are made of fiberglass.

* * * * *